US007607923B2

(12) United States Patent
Jordan et al.

(10) Patent No.: US 7,607,923 B2
(45) Date of Patent: Oct. 27, 2009

(54) ELECTRICAL CONNECTING DEVICE

(75) Inventors: Peter Jordan, Basingstoke (GB); Jean Christophe Villian, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 2 days.

(21) Appl. No.: 12/012,314

(22) Filed: Feb. 1, 2008

(65) Prior Publication Data

US 2008/0132093 A1 Jun. 5, 2008

Related U.S. Application Data

(63) Continuation-in-part of application No. PCT/GB2006/002991, filed on Aug. 10, 2006.

(30) Foreign Application Priority Data

Aug. 16, 2005 (GB) ..... 0516789.5

(51) Int. Cl.
*H01R 12/00* (2006.01)

(52) U.S. Cl. ..... 439/67

(58) Field of Classification Search ..... 439/67, 439/66, 862, 69, 71, 73, 91, 596, 695, 131, 439/79, 76.1, 683–686; 361/684, 752, 756
See application file for complete search history.

(56) References Cited

U.S. PATENT DOCUMENTS

| | | | | |
|---|---|---|---|---|
| 4,548,451 | A | 10/1985 | Benarr et al. | |
| 6,579,104 | B1 * | 6/2003 | Bishop et al. | 439/66 |
| 6,969,262 | B2 * | 11/2005 | Suzuki et al. | 439/66 |
| 6,991,472 | B2 * | 1/2006 | Du et al. | 439/66 |
| 2004/0127073 | A1 * | 7/2004 | Ochiai | 439/66 |

* cited by examiner

*Primary Examiner*—Jean F Duverne
(74) *Attorney, Agent, or Firm*—Peter Van Winkle

(57) ABSTRACT

An electrical connecting device for two electrical components which, when assembled, have electrical contact areas facing each other. The electrical connecting device comprises: a plurality of metallic connecting elements, each connecting element having first and second contact portions resiliently compressible against each other; and a flexible dielectric carrier sheet for the connecting elements, a portion of each connecting element being attached to the carrier sheet. Each connecting element comprises a strip of material having a bend at an intermediate portion. In the device, the connecting elements are resiliently compressible against each other, independent of any supporting structure. A rigid supporting structure is accordingly not required.

8 Claims, 4 Drawing Sheets

ELECTRICAL CONNECTING DEVICE

CROSS-REFERENCE

This is a Continuation-In-Part of PCT/GB2006/002991 filed 10 Aug. 2006 which claimed priority from British patent application GB 0516789.5 filed 16 Aug. 2005.

BACKGROUND OF THE INVENTION

This invention relates to an electrical connecting device. In particular, this invention relates to an electrical connecting device of the type used to provide an electrical connection between electrical contact areas formed on different electrical components.

Modern electronic devices typically comprise a number of electrical components that are electrically connected together and assembled into a casing.

For example, a mobile telephone may comprise a main printed circuit board, a liquid crystal display module, and a number of other electrical components. In the mobile telephone, electrical contact areas formed on the main printed circuit board may be electrically connected to corresponding electrical contact areas formed on a rear surface of the display module. The electrical connections allow the printed circuit board to drive the display module.

A known way of providing the electrical connection between the electrical contact areas of the printed circuit board and the display module is to assemble them so that the contact areas physically touch each other. However, this provides an electrical connection that is susceptible to mechanical shock, and is thus unreliable. Moreover, it is frequently not possible to arrange the printed circuit board and the display module so that the contact areas physically touch each other.

It is also known to use an electrical connecting device to provide the electrical connection between the electrical contact areas of the printed circuit board and the display module. An electrical connecting device of this type is disclosed, for example, in EP 1168510. In the electrical connecting device of EP 1168510, a plurality of elongate metallic connecting elements are molded into a dielectric body. One end of each connecting element is unsupported, so that it may be resiliently biased.

In use, the connecting device of EP 1168510 may be secured to the printed circuit board with the supported (molded in) end of each connecting element being soldered to an electrical contact area of the board. The printed circuit board and the display module may then be assembled together so that the unsupported end of each connecting element is in contact with, and urged against, an electrical contact area of the display module.

The resilient nature of the connecting elements of the connecting device disclosed in EP 1168510 enables the making of a reliable, gas-tight electrical connection. However, this and other known connecting devices have a number of limitations.

SUMMARY OF THE INVENTION

According to the invention, there is provided an electrical connecting device for two electrical components which, when assembled, have electrical contact areas facing each other, the electrical connecting device comprising: a plurality of metallic connecting elements, each connecting element having first and second contact portions resiliently compressible towards each other; and a flexible dielectric carrier sheet for the connecting elements, a portion of each connecting element being attached to the carrier sheet.

The invention thus provides a simplified connecting device. The contact portions of the connecting elements are resiliently compressible towards each other, and this is independent of any supporting structure. A rigid supporting structure is accordingly not required (although such may additionally be included), and a flexible carrier sheet can be employed. The flexible carrier sheet maintains the desired spatial layout "of, and clearance between, the connecting elements.

The device of the invention can be designed to be simple to manufacture and assemble, and enables flexibility in designing the layout and positioning of the connecting elements. Compared to known connecting devices, it may also be possible to assemble the device between electrical components with a reduced spacing, since there is no requirement for a rigid support structure.

Each connecting element preferably comprises an elongate strip of material having a bend at an intermediate portion (although other arrangements are possible). The intermediate portion defines the first contact portion, and one or both end portions of the strip define second contact portions. The bend at the intermediate portion preferably defines an obtuse angle, most preferably in the range 1000 to 1400. In use, the strip behaves as a leaf spring.

The strip preferably has bends at one or both of the end portions, as well as at the intermediate portion. The bends at the end portions are preferably formed in an opposite direction to the bend at the intermediate portion. In this way, all of the contact portions are rounded, enabling them to slide relative to the electrical contact areas of the two electrical components between which they may be assembled.

In a preferred embodiment, a width of the strip tapers from the intermediate portion, where it is at its largest, to the end portions, where it is at its smallest. In this configuration, the strip has good mechanical strength, while the narrow end portions provide effective electrical contact portions.

The strip preferably has a cross section that includes one or more straight sides. The straight sides of the cross section help to maintain the correct orientation of the strip on the carrier sheet and when assembled between electrical components, i.e. they prevent it from rotating. The strip most preferably has a rectangular cross section.

An end portion of the strip may be attached to the carrier sheet. For example, the end portion may be attached to a hinged portion of the carrier sheet. Alternatively, the intermediate portion of the strip may be attached to the carrier sheet. In this case, an elongate carrier sheet may extend perpendicular to the strip.

The first and second contact portions of each connecting element preferably face substantially opposite directions in their uncompressed state. It is then not necessary for the connecting elements to be physically formed into shape when the device is assembled between electrical components.

The connecting elements may be attached to the carrier sheet by adhesive bonding. A variety of adhesive compositions are suitable, including selfadhesive and heat curable types.

The carrier sheet preferably comprises attachment means for attaching the device to an electrical component, such as a printed circuit board. The attachment means may comprise an adhesive coated portion of the carrier sheet, and a backing sheet may also be provided.

The carrier sheet may have a thickness of 0.2 mm or less, and the thickness is preferably in the range 0.05 mm to 0.15 mm. A variety of materials are suitable for the carrier sheet, including polyesters such as that sold under the Mylar® name.

The invention also provides an electrical assembly (such as a mobile telephone) comprising: two electrical components having electrical contact areas facing each other; and the electrical connecting device as described above, wherein the electrical connecting device provides electrical connections between the electrical contact areas of the two electrical components.

The novel features of the invention are set forth with particularity in the appended claims. The invention will be best understood from the following description when read in conjunction with the accompanying drawings.

BRIEF DESCRIPTION OF THE DRAWINGS

The invention will now be described in detail, by way of example only, with reference to the accompanying drawings, in which.

DESCRIPTION OF THE PREFERRED EMBODIMENT

Figure 1:
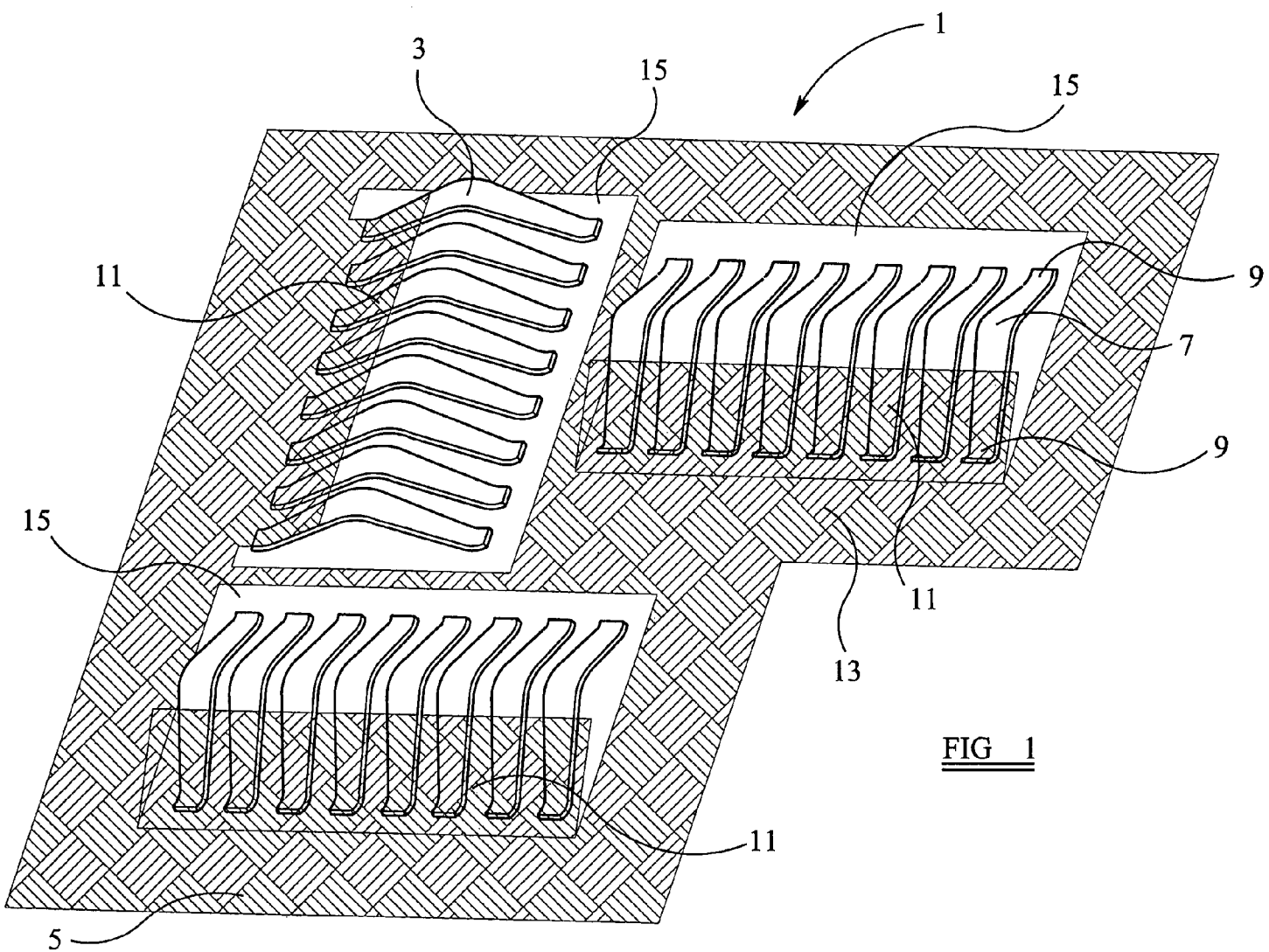
FIG. 1 is an isometric view of a first electrical connecting device according to the invention.

FIG. 1 shows a first electrical connecting device 1 according to the invention. Referring to the Figure, the device 1 comprises a plurality of connecting elements 3 attached to a flexible dielectric carrier sheet 5.

Each connecting element 3 is an elongate metallic strip. The metallic strip is formed from 0.08 mm thick stainless steel, which is plated with copper to a depth of 5 μm, then nickel to a depth of 3 μm, and then gold to a depth of 0.5 μm.

The strip is approximately 8.0 mm in total length. The strip has a bend at an intermediate portion 7. The bend at the intermediate portion 7 defines an angle of approximately 1200. End portions 9 of the strip also have bends of approximately the same angle, formed in an opposite direction to the bend at the intermediate portion 7. The radii of the bends at the end portions 9 are smaller than the radius of the bend at the intermediate portion 7.

The intermediate portion 7 (FIG. 2) of the strip defines a first electrical contact portion (for a first electrical component, such as a display module) at a top 6 of the intermediate portion, and defines a pair of inclined parts 8, 10 (FIG. 2) extending from the top along opposite downward inclines from opposite sides of the top to end portions of the strip. The inclined parts 8, 10 are each straight along most of its length. The end portions 9 of the strip define two second electrical contact portions (for, a second electrical component, such as a printed circuit board). The first and second contact portions face in substantially opposite directions and each has a convex lower surface.

The width of the strip tapers from the intermediate portion 7, where it measures approximately 1.5 mm, to the end portions 9, where it measures approximately 1.0 mm. In its uncompressed state, the strip measures approximately 6.4 mm in length and approximately 2.0 mm in height.

The strip is resiliently compressible, so that the intermediate portion 7 may be resiliently compressed against the end portions 9. In the present example, a force of 0.5N is sufficient to reduce the height of the strip from 2.0 mm to 1.5 mm. In compressing the strip, the length of the strip increases slightly, and the bends at the intermediate portion 7 and the end portions 9 enable the contact portions to slide smoothly to accommodate this extension.

The carrier sheet 5 is a 0.05 mm thick flexible polyester (Mylar®) sheet having a 0.05 adhesive layer applied to one side. The adhesive is a self-adhesive composition. Such compositions will be well known to those skilled in the art. The sheet 5 may be any color, but in the present example it is transparent to aid correct location of the connecting device when it is assembled onto an electrical component. Location marks (not shown) are printed on the carrier sheet 5 for alignment with corresponding marks on an electrical component to which it is to be assembled.

The carrier sheet 5 comprises three hinge portions 11 connected to an attachment portion 13. The attachment portion 13 has cut-outs 15 adjacent to the hinge portions 11 that extend at an incline from the attachment portion.

The connecting elements 3 are attached to the hinge portions 11 of the carrier sheet 5, as shown in the Figure, so that the connecting elements 3 are positioned in the cut-outs 15. The connecting elements 5 are arranged in the cut-outs 15, with a 1 mm separation therebetween. In this way, the dielectric carrier sheet 5 provides an insulating function, as well as a function of maintaining the layout of the connecting elements 3.

The connecting elements 3 are attached to the hinge portions 11 of the carrier sheet 5 by the upper surface of one of their end portions 9. The attachment is by way of the self-adhesive composition, which composition is adapted to provide a permanent bond. In this way, the electrical contact portions of the connecting elements 5 are all exposed. Furthermore, the intermediate portions 7 (the first electrical contact portions) of the connecting elements 3 all point upwards.

The device 1 is provided on a backing paper (not shown), the adhesive coated carrier sheet 5 being easily detachable therefrom. A plurality of the devices 1 are provided on a reel of the backing paper, but only one such device is shown in FIG. 1.

Figure 2:
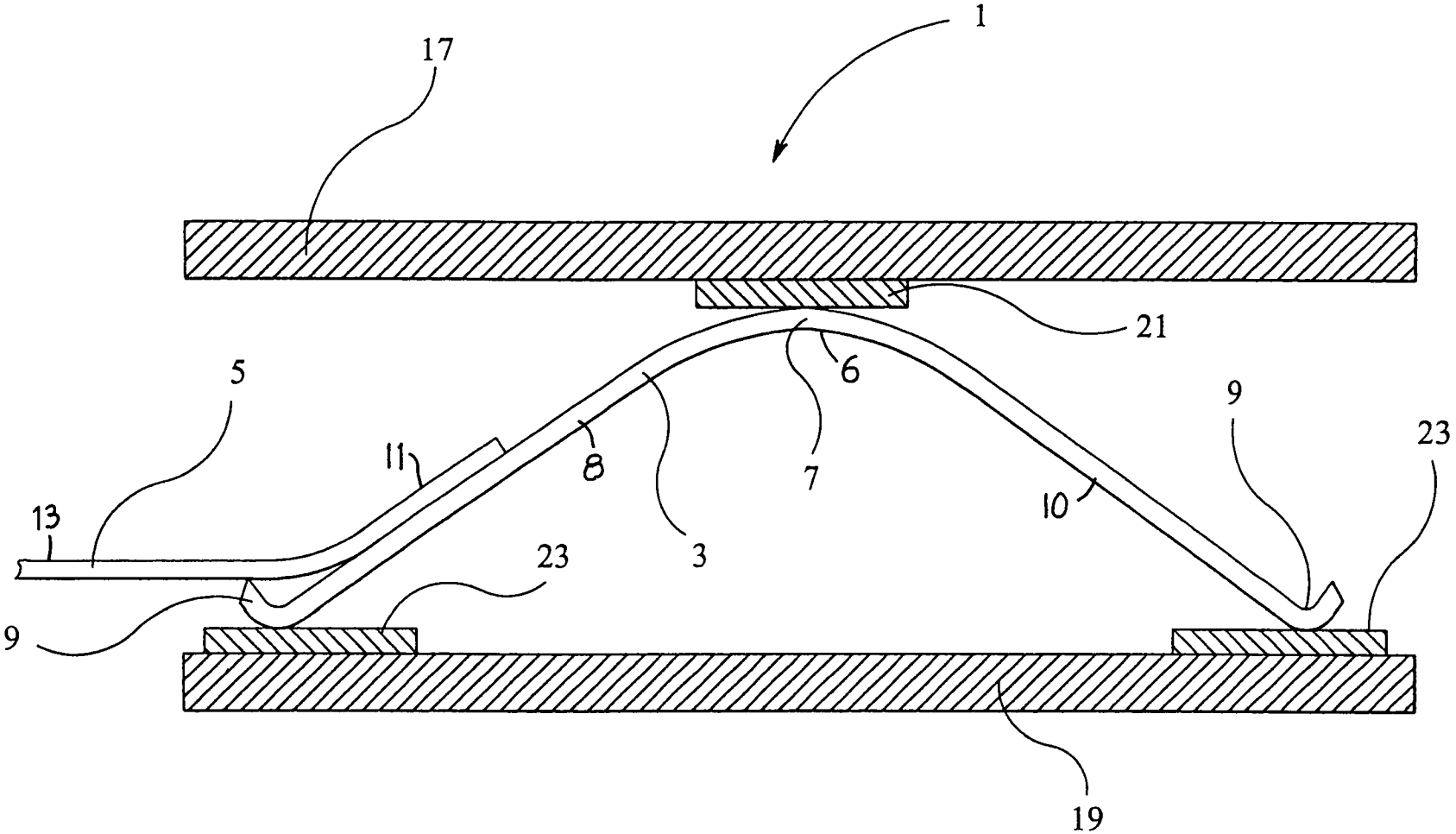
FIG. 2 is a partial schematic side view of the device shown in FIG. 1, assembled between two electrical components.

In use, the device 1 is assembled between a first electrical component 17 and a second electrical component 19, as shown in FIG. 2.

In particular, the backing paper (not shown) is firstly removed from the device I to expose the adhesive layer of the carrier sheet 5. The device 1 is then attached to the second electrical component 19 so that the end portions 9 (the second electrical contact portions) of the connecting elements 3 are in contact with and rest on electrical contact areas 23 formed on the second electrical component 19. The attachment is by means of the self-adhesive layer provided on the attachment portion 13 of the carrier sheet 5.

Next, the second electrical component 19, with the device 1 attached thereto as described above, is assembled into a casing (not shown) with the first electrical component 17. The assembly process involves using spacing elements (not shown) to ensure a consistent spacing of 1.5 mm between the first and second electrical components 17, 19. The components 17, 19 are assembled so that electrical contact areas 21 formed on the first electrical component 17 come into contact with and press against the intermediate portions 7 (the second electrical contact portions) of the connecting elements 3.

With a spacing of 1.5 mm, the intermediate portions 7 of the connecting elements 3 are compressed by 0.5 mm, causing the end portions 9 of the connecting elements 3 to separate slightly. Since one of the end portions 9 of each connecting element 3 is connected to a hinge portion 11 of the carrier sheet 5, the intermediate portion 7 and the other end portion 9 slide a small amount against the electrical contact portions 21, 23 to accommodate the separation. The hinge portion 11 of the carrier sheet 5 also hinges slightly relative to the attachment portion 13 as each connecting element is compressed. At 0.5 mm compression, each connecting element 3 exerts a pressure of 0.5 N on the electrical components 17, 19, thereby ensuring a reliable, gas-tight connection.

As shown in FIG. 1, the connecting elements 3 are separated into three arrays. In this way, the total pressure exerted by the connecting elements 3 on the electrical components 17, 19 is spread across a large area, thereby, minimizing any distortion of the electrical components 17, 19.

Figure 3:
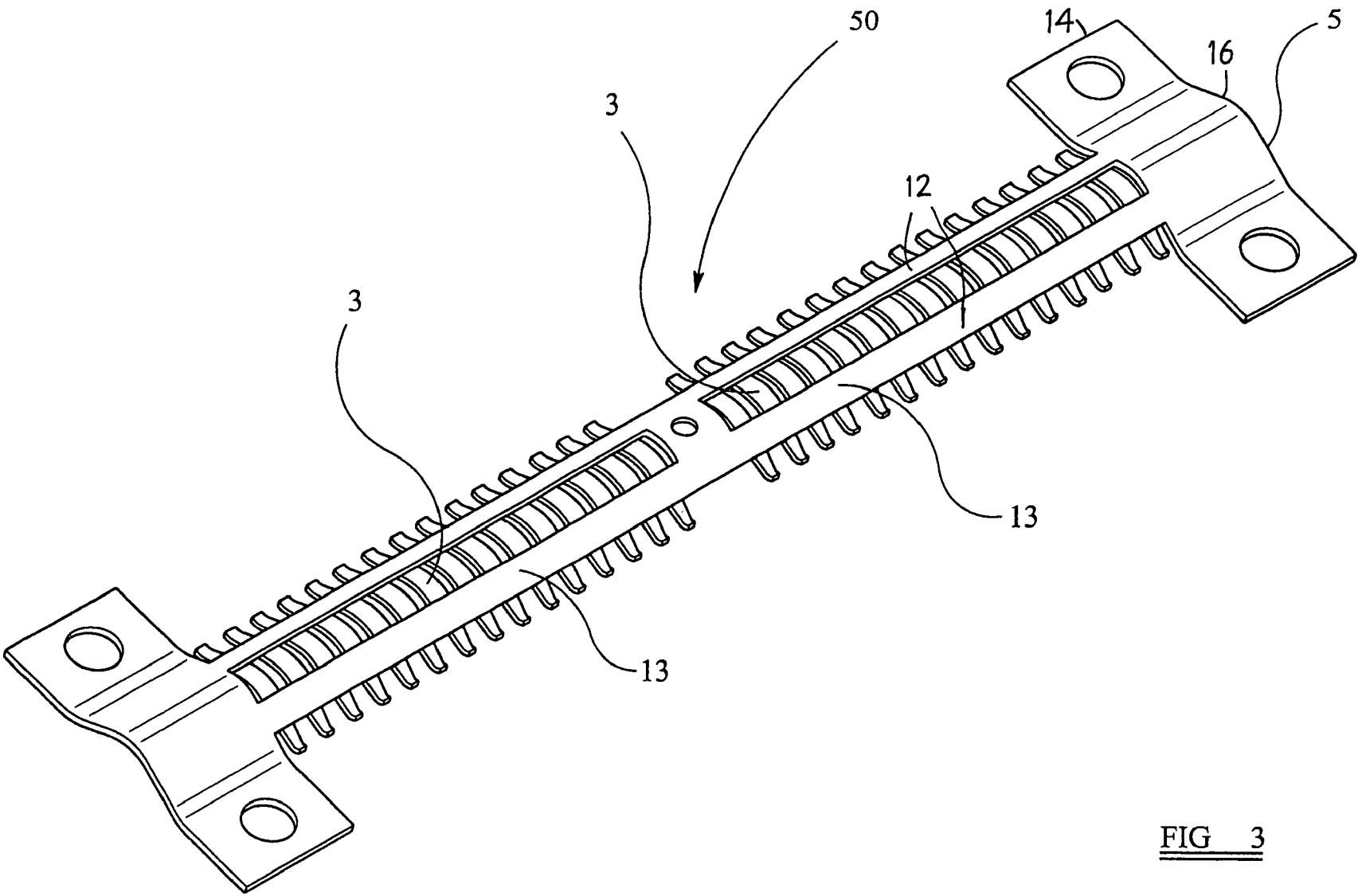
FIG. 3 is an isometric view of a second electrical connecting device according to the invention.
Figure 4:
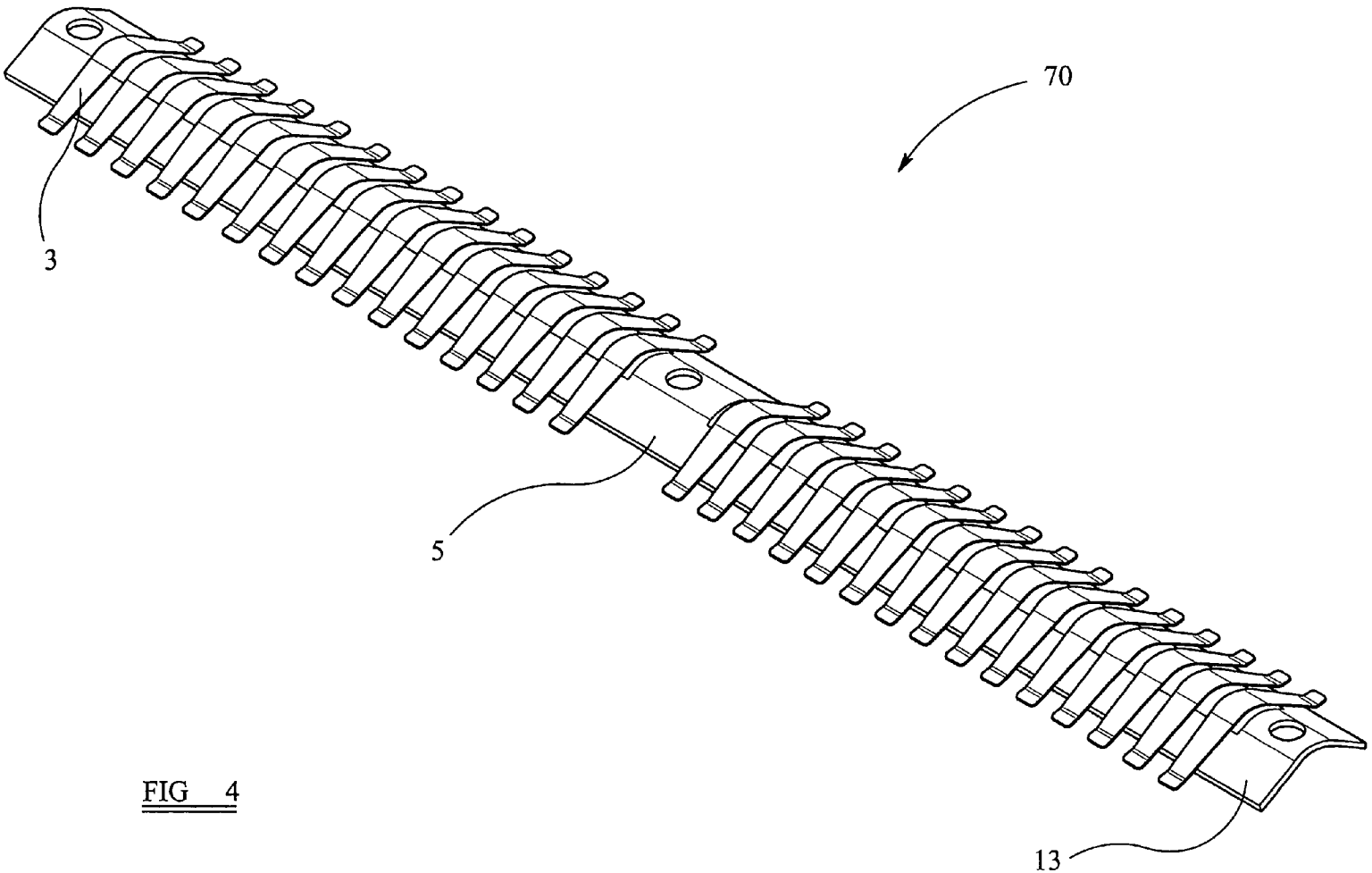
FIG. 4 is an isometric view of a third electrical connecting device according to the invention.

FIGS. 3 and 4 show second and third electrical connecting devices 50, 70 according to the invention. The second and third devices 50, 70 are similar to the first device 1 shown in FIGS. 1 and 2, and the same reference numerals have been employed for common features.

The main difference between the second and third devices 50, 70 and the first device I concerns the carrier sheet 5, and the way in which the connecting elements 3 are attached to the carrier sheet 5.

In the second and third devices, 50, 70, the carrier sheet 5 is a 0.05 mm thick polyester sheet having a 0.10 adhesive layer applied to one side. The adhesive layer in these examples is a heat curable adhesive composition. Such compositions will be well known to those skilled in the art.

The carrier sheet 5 is elongate in shape, comprising two long, thin parallel bands that are flexible. Each connecting elements 3 is attached to the bands on respective opposite sides of its intermediate portion 7. The carrier sheet 5 has a molded shape, so that at the attachment locations it has surfaces that match those of the connecting elements 3. The carrier sheet 5 includes end pieces 14 with curved parts 16 having convex tons and attached to the bands 12.

The connecting elements 3 are attached perpendicular to the bands of the carrier sheet 5. The connecting elements 3 are attached by locally applying heat to cure the adhesive layer of the carrier sheet 5.

The carrier sheet 5 also comprises attachment portions 13 located at the ends of the elongate bands. The attachment portions 13 have pilot holes 25 formed therein for use in locating the device 50, 70 on an electrical component. Once the device 50, 70 has been located, then the carrier sheet is attached to the electrical component by locally applying heat to the attachment portions 13 to cure the adhesive layer of the carrier sheet 5.

The main difference between the second and third devices 50, 70 is that different surfaces of the carrier sheets 5 are attached to different surfaces of the connecting elements 3.

In use, the devices 50, 70 are assembled in a similar way to that of the first device 1. Essentially, the devices 50, 70 are assembled between first and second electrical components each having electrical contact areas. The connecting elements 3 are compressed during assembly, and the carrier sheets 5 flex to accommodate the resulting deformation.

Specific examples of the invention have been described in detail. Various modifications within the scope of the claims will be apparent to the person skilled in the art.

For example, in the examples described above, a single adhesive composition is used to attach the connecting elements 3—to the carrier sheets 5, and to attach the carrier sheets 5 to electrical components 17, 19. However, different adhesive compositions may be used for each of these functions, according to the materials being bonded. Entirely different attachment means such as welding may also be employed.

In the examples described above, the end portions define two second contact portions for making an electrical connection with one electrical component. However, only one second contact portion is essential, and in this case one end portion may simply be used for attaching the connecting element to the carrier sheet.

The connecting elements of the above described examples are strips of material having a bend at an intermediate portion. The bend may have a variety shapes, and the radius of the bend may be sufficiently large that it is not exclusively located at the intermediate portion of the strip. It should be noted that other types of connecting element are possible, including elements having more than two end portions, for example a tripod shaped element, and elements comprising helical coils of material. All that is required is that the connecting element has first and second contact portions resiliently compressible towards each other. The term "towards each other" is not of course limited to movement of the two portions directly towards each other, but refers to movement of a plane carrying one portion towards a parallel plane carrying the other terminal.

Thus, each contact arrangement such as the one shown in FIG. 1, includes a dielectric carrier sheet 5 and a row of contact elements 3 mounted on the carrier sheet. Each contact element has an intermediate portion 7 with a convex upper surface and has first and second opposite end portions 9 with convex lower surfaces. Of course the terms "upper" and "lower" are only relative terms and the arrangement can be used in any orientation with respect to up and down directions.

The contact elements 3 are strip shaped and tapered in width, with the intermediate portion 7 (which experiences the greatest bending stress) being of greatest width. As shown in FIG. 2, the intermediate portions 7 of contact elements press against contacts 21 of an upper device 1. The bends at the end portions 9 of the contact elements press against locations on a lower device 19, with at least one locations being the location of a contact 23 on the lower device.

The carrier sheet 5 of FIG. 1 lies against the upper surface of the contact elements. As shown in FIG. 2, the carrier strip lies spaced from and between the intermediate portion 7 and one of the end portions 9. However, the carrier strip is attached to the contact elements at locations spaced from adjacent bends 9 at one end of each contact element.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connecting arrangement comprising:

a dielectric carrier sheet;

a plurality of conductive contact elements arranged in a row and mounted on said carrier sheet, each contact element having an intermediate portion and first and second opposite end portions;

said intermediate portions of said contact elements having intermediate bends with convex upper surfaces and said first end portions have first end bends with convex lower surfaces;

said second end portions of said contact elements have second end bends with convex lower surfaces;

said carrier sheet lies against the upper surfaces of said second end portions of said contact elements, while leaving said intermediate bends and said second bends of said contact elements uncovered.

2. An electrical connecting arrangement comprising:

a dielectric carrier sheet;

a plurality of conductive contact elements arranged in a row and mounted on said carrier sheet, each contact element having an intermediate portion and first and second opposite end portions;

said intermediate portions of said contact elements having intermediate bends with convex upper surfaces and said first end portions have first end bends with convex lower surfaces;

said carrier sheet lies against upper surfaces of said contact elements along their intermediate portions, while leaving the lower surfaces of said contact element first and second end portions uncovered.

3. An electrical connecting device for first and second electrical components which, when assembled, have respective upper and lower electrical contact areas largely facing each other, the electrical connecting device comprising a plurality of metallic connecting elements and a dielectric carrier sheet that is attached to the connecting elements, wherein:

each of said connecting elements includes an intermediate portion (7) with a top (6) having a convex upper surface that engages one of said upper contact areas of said first component, and with a pair of downwardly inclined parts (8, 10) extending in opposite directions and at downward inclines away from said top and away from each other with said contact elements having opposite end portions (9) at ends of said inclined parts that press against said second component, and with a first of said end portions having a lower surface that presses against one of said lower contact areas of said lower components.

4. The device described in claim 3 wherein:

said carrier sheet is attached to one of said inclined parts of each connecting element.

5. The device described in claim 3 wherein:

said dielectric carrier includes an attachment portion (13) that lies in a horizontal plane and also includes an inclined hinge portion (11) that extends at an incline from said attachment portion and that adheres to one of said inclined parts of said connecting elements.

6. The device described in claim 3 wherein:

said opposite end portions of each of said connecting elements each has a convex lower surface.

7. The device described in claim 3 wherein:

said connecting element lie in a row;

said dielectric carrier includes a pair of elongated strips that are each attached to inclined parts of said row of connecting elements, said dielectric carrier including a pair of carrier end pieces (14) that lie beyond an end of said row of connecting elements, said carrier end pieces each having an end piece part (16) that extends in a curve with a convex top.

8. The device described in claim 3 wherein:

said downwardly inclined parts are straight along a majority of their lengths.

* * * * *